US009428358B2

(12) United States Patent
Gao

(10) Patent No.: US 9,428,358 B2
(45) Date of Patent: Aug. 30, 2016

(54) FLAKY MEDIUM PROCESSING SYSTEM AND METHOD FOR DETECTING REAL-TIME POSITION OF FLAKY MEDIUM

(71) Applicant: GRG Banking Equipment Co., Ltd., Guangzhou, Guangdong (CN)

(72) Inventor: Ping Gao, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/436,870

(22) PCT Filed: Jun. 25, 2013

(86) PCT No.: PCT/CN2013/077871

§ 371 (c)(1),
(2) Date: Apr. 17, 2015

(87) PCT Pub. No.: WO2014/071739

PCT Pub. Date: May 15, 2014

(65) Prior Publication Data

US 2015/0284205 A1 Oct. 8, 2015

(30) Foreign Application Priority Data

Nov. 6, 2012 (CN) ..... 2012 1 0438773

(51) Int. Cl.
*B65H 7/02* (2006.01)
*B65H 9/20* (2006.01)
(Continued)

(52) U.S. Cl.
CPC *B65H 9/20* (2013.01); *B65H 7/02* (2013.01); *B65H 7/06* (2013.01); *B65H 7/14* (2013.01);
(Continued)

(58) Field of Classification Search
CPC ..... B65H 7/14; B65H 2553/416; B65H 2553/822; B65H 2701/1712; B65H 2701/1718; B65H 2701/1912
See application file for complete search history.

(56) References Cited

U.S. PATENT DOCUMENTS 5,427,366 A * 6/1995 Sakamori ..... G07D 7/16 271/125
8,985,299 B2 * 3/2015 Liao ..... G07D 7/12 194/216

(Continued)

FOREIGN PATENT DOCUMENTS

CN 1340793 A 3/2002
CN 1405731 A 3/2003

(Continued)

OTHER PUBLICATIONS

European Search Report, dated Oct. 29, 2015, from corresponding European Application No. 13853857.4.

(Continued)

*Primary Examiner* — Jeremy R Severson
(74) *Attorney, Agent, or Firm* — Wolf, Greenfield & Sacks, P.C.

(57) ABSTRACT

A flaky medium processing system and a method for detecting a real-time position of a flaky medium. Multiple detection positions are arranged in a medium transfer channel of the flaky medium processing system, and one position sensor is arranged at each detection position for detecting arrival and departure events of the flaky medium in the detection position; and the flaky medium processing system and the method are characterized in that the position sensor arranged at the first detection position along the movement direction of the flaky medium is provided with at least three scattered detection points, each detection point outputs an independent output signal, and each detection point is configured with two timers for obtaining a time attribute of an output signal of each detection point; and the position sensor arranged at each of other detection positions is configured with one timer for obtaining the time attribute of the output signal of the common position sensor.

6 Claims, 5 Drawing Sheets

(51) Int. Cl.

| | |
|---|---|
| ***B65H 7/20*** | (2006.01) |
| ***B65H 7/06*** | (2006.01) |
| ***B65H 7/14*** | (2006.01) |
| ***G07D 7/16*** | (2016.01) |

(52) U.S. Cl.

CPC ..... *B65H 7/20* (2013.01); *G07D 7/162* (2013.01); *G07D 7/168* (2013.01); *B65H 2511/20* (2013.01); *B65H 2511/242* (2013.01); *B65H 2513/511* (2013.01); *B65H 2553/822* (2013.01); *B65H 2701/1912* (2013.01)

(56) References Cited

U.S. PATENT DOCUMENTS

| | | | | |
|---|---|---|---|---|
| 2005/0117792 | A2* | 6/2005 | Graves | B65H 3/063 382/135 |
| 2013/0129140 | A1* | 5/2013 | Liang | G07D 7/00 382/100 |
| 2014/0224615 | A1* | 8/2014 | Liao | B65H 7/06 194/207 |
| 2014/0249769 | A1* | 9/2014 | Liao | G07D 11/0084 702/128 |

FOREIGN PATENT DOCUMENTS

| | | | |
|---|---|---|---|
| CN | 101916470 | A | 12/2010 |
| CN | 102142169 | A | 8/2011 |
| CN | 102254370 | A | 11/2011 |
| CN | 102411805 | A | 4/2012 |
| CN | 102633142 | A | 8/2012 |
| CN | 102910468 | A | 2/2013 |
| CN | 102693579 | A | 9/2015 |
| JP | H0733288 | A | 2/1995 |
| JP | H 885671 | A | 4/1996 |
| JP | 2005182260 | A | 7/2005 |
| TW | 200823140 | A | 6/2008 |
| WO | WO 2011092824 | A1 | 8/2011 |

OTHER PUBLICATIONS

International Search Report dated Oct. 3, 2013 from corresponding International Application No. PCT/CN2013/077871.

Written Opinion of the International Searching Authority, dated Oct. 3, 2013, from corresponding International Application No. PCT/CN2013/077871.

Chinese Office Action, dated Jul. 3, 2014, from corresponding or related Chinese Application No. 201210438773.9.

* cited by examiner

FLAKY MEDIUM PROCESSING SYSTEM AND METHOD FOR DETECTING REAL-TIME POSITION OF FLAKY MEDIUM

This application is the national phase of International Application No. PCT/CN2013/077871, filed on Jun. 25, 2013, which claims the priority benefit of Chinese patent application No. 201210438773.9, titled "FLAKY MEDIUM PROCESSING SYSTEM AND METHOD FOR DETECTING REAL-TIME POSITION OF FLAKY MEDIUM" and filed with the Chinese State Intellectual Property Office on Nov. 6, 2012, which applications are hereby incorporated by reference to the maximum extent allowable by law.

FIELD

The disclosure relates to an automatic transfer control technology for a flaky medium, and particularly to a processing system for continuously classifying flaky mediums and storing the flaky mediums into a predetermined position, and a method for detecting a real-time position of a flaky medium.

BACKGROUND

A processing system for continuously classifying flaky mediums and storing the flaky mediums into a predetermined position automatically is referred to as a flaky medium processing system for short. For ease of description, it's provided a flaky medium processing system as follows, which includes (a) a built-in main controller configured to perform automatic control on each constituent part of the system; (b) a flaky medium transfer channel having branches; (c) multiple places for storing the flaky medium (flaky medium storage); (d) a component for classifying the flaky medium, such as a bank note identifier; (e) multiple sensors configured to detect a position of the flaky medium; (f) multiple electric execution elements; (g) a structural component for transferring the flaky medium.

The flaky medium processing system has the following features.

(1) The volume of the flaky medium processing system is strictly limited.

(2) A shape of a processed flaky medium is a rectangle, and the flaky medium moves at a constant speed.

(3) Since the length of the transfer channel is much greater than that of the flaky medium, and the flaky medium can be processed continuously by the flaky medium processing system, the system has to process multiple flaky mediums simultaneously.

(4) A component for classifying the flaky medium has its own independent controller, and a communication line is disposed between the controller and the main controller, to send classified information to the main controller.

(5) In order to transfer the flaky medium to a predetermined flaky medium storage accurately, the main controller has to accurately know a real-time position of the flaky medium in the transfer channel and the number of flaky mediums in the flaky medium storage by a position sensor.

(6) A requirement for a real-time performance is high, in a typical case, the number of sheets of the flaky medium processed by the system per second is over 10, and since the volume of the system is limited, the main controller has to know an exact position of the flaky medium within a very short time.

(7) A position sensor is installed at a position of the transfer channel close to an entrance of a flaky medium storage, the number of flaky medium entering in or exiting from the storage is counted by the main controller, and the number of the flaky medium in the warehouse may be acquired accurately in conjunction with the number of the flaky medium prestored in the storage.

Operating Principle of the Position Sensor

The position sensor normally detects a position of the flaky medium by using an optical method. The position sensor includes two parts, where A is an optical emitting terminal, and B is a light-sensitive terminal, light emitted by A is irradiated onto the light-sensitive terminal B, and the light-sensitive terminal transforms the strength of the light into a voltage signal to output. In a case that there is no flaky medium blocking a light path between A and B (that is, there is no flaky medium passing by the light path), a voltage output by the optical-sensitive terminal is low; and in a case that there is a flaky medium blocking the light path between A and B (that is, there is a flaky medium passing by the light path), the voltage output by the optical-sensitive terminal is high. The controller will know whether there is a flaky medium between A and B by detecting the voltage output by the light-sensitive terminal. Multiple such sensors are provided on the flaky medium transfer channel, the controller can sense the real-time position of the flaky medium on the transfer channel.

DEFINITION FOR A HOLE

Due to the optical detection principle of the position sensor, in a case that the flaky medium is complete but with a transparent area in the flaky medium, a signal output by the position sensor is the same as the signal when there is no flaky medium blocking the light path; alternatively, in a case that there is a damage area on the flaky medium, the signal output by the position sensor is the same as the signal when there is no flaky medium blocking the light path. The transparent area or the damage area is referred to as a hole.

PROBLEM TO BE SOLVED

When the hole on the flaky medium passes by the position sensor, the signal output by the position sensor is the same as the signal when there is no flaky medium, therefore, an error occurs easily when the main controller determines the position of the flaky medium and the number of sheets of the flaky medium.

Therefore, a problem to be solved is that the main controller is able to accurately determine the position of the flaky medium and count the number of sheets of the flaky mediums even when there is a hole on the flaky medium.

Existing Method

A position sensor is provided at a position of the transfer channel where it is required to respond based on the position of the flaky medium. Typically, the position sensors are provided in front of and at the back of a branch point of the transfer channel; the position sensor is provided at a position of the transfer channel close to the entrance of a flaky medium storage. Therefore, it is required to provide multiple position sensors in the system.

An existing method for detecting a position of the flaky medium in the transfer channel and counting the number of sheets of the flaky medium includes the following methods.

In a first method, a sensor having multiple detection points is used at each position.

A position sensor having multiple optical paths and multiple detection points is used, which avoids that each of the optical paths passes through the hole, voltages output from the multiple detection points are digitized and calculated, therefore, accurate position information of the flaky medium may be obtained.

Disadvantages: space occupied by the position sensor is large, so that the volume of the whole flaky medium processing system becomes large; and since the number of sensors is large, and wiring thereof is complex, it is not beneficial to improve the reliability; and the cost is high.

In a second method, a simple sensor is used at each position.

With reference to the foregoing description, in a case that a simple sensor meets with a hole on a bank note, errors occur easily when the main controller determines the position of the flaky medium and counts the number of sheets of the flaky medium. Therefore, it is required for the main controller to use a software filtering algorithm to avoid the problem.

It is required for the software filtering algorithm to know the size of the hole on a processed flaky medium in advance, and then a filtering parameter is determined based on the size of the hole. In a case that the hole (a transparent window on a plastic bank note) is added on purpose when the flaky medium is manufactured, the software should set different filtering parameters for different types of flaky medium; and in a case that the hole is a damage caused when the flaky medium is used, the software should set a filtering parameter based on an accepted damage degree.

Before the flaky medium passes by a classifying component, the controller does not know the type of the flaky medium, and also does not know whether the flaky medium is broken, therefore, the filtering parameter set in advance cannot be used, and only a strategy in which it's always provided that there is a hole on the flaky medium and the size and the position of the hole are fixed can be employed.

After the flaky medium passes by the classifying component, I, the controller can select a suitable filtering parameter by using data output from the classifying component. In order to get a good result, different filtering parameters may be used for different flaky mediums, that is, the filtering parameters are changed dynamically for the same position signal. Therefore, the complexity of the control software is increased greatly. And the complexity of the classifying component is also increased, the classifying component is required to output the size and the position information of the hole on the flaky medium. When there is a difference between a standard for determining the hole by the classifying component and a standard for determining the hole by the position sensor on the main controller, and the classifying component may regard that there is no hole on the flaky medium, however the position sensor on the main controller detects the hole, a control error occurs. II. The controller may also adopt the strategy in which it's always provided that there is a hole on the flaky medium and the size and the position of the hole are fixed.

In addition, the flaky medium tilts or mismatches when being transferred in the system. In this way, the main controller will senses that the size of the hole is different from a preset value, and therefore, the position of the flaky medium is determined to be inaccurate, and the number of sheets of the flaky medium is inaccurate.

In order to handle multiple cases described above, actually, the controller adopts the strategy in which it's always provided that there is a hole on the flaky medium and the size and the position of the hole are fixed. Therefore, the system only uses one filtering parameter. In order to make the system more applicable, the filtering parameter used by the main controller tends to allow the flaky medium with a large hole to pass by the system successfully.

Disadvantages:

(1) it is difficult to determine an optimal filtering parameter, and it is required to redefine an filtering parameter when the shapes of the flaky medium are changed greatly.

(2) The precision of detecting the position of the flaky medium is not high. In the existing method, an arrival time point of the flaky medium can be detected precisely, however, a departure time point of the flaky medium cannot be detected precisely.

(3) The signal for reflecting the real-time position of the flaky medium has a great time delay, this is not beneficial for real-time control; and it is required for the filtering algorithm to occupy an execution time of CPU inside of the controller frequently, the more the sensors are, the longer the occupied execution time is, this is an unfavorable factor for the system needing a high real-time performance.

The reason for signal delay is that, after the signal output by the position sensor is changed into a low voltage signal (that is, there is no flaky medium blocking), the controller cannot immediately determine that this is caused by the hole on the flaky medium or caused by the situation that the flaky medium departs from the sensor. In a case that the low voltage signal restores into a high voltage signal while a duration of the low voltage signal does not reach a preset threshold, the controller determines that this is caused by the hole on the flaky medium; and in a case that the duration of the low voltage signal is greater than the preset threshold, the controller determines that the flaky medium departs from the sensor, however at the moment the flaky medium has already departed from the position sensor. The larger the size of the hole accepted by the main controller is, the longer the time delay is. Therefore, this method is not suitable for a high-speed flaky medium processing system.

SUMMARY

One of objects of the disclosure is to provide a flaky medium processing system, to accurately detect a real-time position of a flaky medium in the transfer channel without significantly increasing the volume and the cost of the system.

Another object of the disclosure is to provide a method for detecting a real-time position of a flaky medium, which can accurately determine an arrival event and a departure event of each flaky medium at a certain detection position, and prevent a problem of multi-trigger and inaccurate count caused by the medium having a hole.

The flaky medium processing system includes: a main controller configured to automatically control each component in the flaky medium processing system in a real-time manner; a medium storage apparatus configured to store a flaky medium; a medium recognizing apparatus configured to recognize, separate and count the flaky medium; a medium transfer apparatus including a motor, a drive mechanism and a medium transfer channel having multiple branches, where multiple detection positions are arranged in the medium transfer channel, and one position sensor is arranged at each detection position for detecting an arrival event and a departure event of the flaky medium at the detection position, characterized in that, a position sensor arranged at a first detection position along a movement direction of the flaky medium is provided with at least three independent detection points, each detection point outputs an independent output signal, and each detection point is configured with two timers for obtaining a time attribute of an output signal of each detection point, and a position sensor arranged at other detection position is configured with one timer for obtaining a time attribute of an output signal of the position sensor.

Preferably, at least one of the at least three independent detection points provided in the position sensor arranged at the first detection position along the movement direction of the flaky medium is aligned with a center line of the medium transfer channel.

Preferably, the position sensor arranged at other detection position includes at least two detection points, and the two detection points are arranged at two sides of the center line of the medium transfer channel.

The method for detection a real-time position of a flaky medium includes: step 1, initializing all position sensors, and stopping and resetting all timers; step 2, processing an output signal of a position sensor arranged at a first detection position along a movement direction of a flaky medium, and acquiring a time attribute T of an output signal of each detection point; step 3, setting a value of the maximum one of the time attributes T of the detection points acquired in step 2 as a reference time Ta; and step 4, processing a signal of a position sensor arranged at other detection position in conjunction with the reference time Ta, where in a case that the any one of detection points of the position sensor is covered, it is determined that a flaky medium to be detected arrives at the detection position, and a timer equipped at the position sensor is started and continues timing, to acquire a time period Tb, where during the time period Tb the flaky medium to be detected passes by the position sensor, or in a case that all detection points at the position sensor are not blocked, and Tb is greater than Ta, it is determined that the flaky medium has already been away from the detection position, and the timer equipped at the position sensor is stopped and reset.

Preferably, step 2 of acquiring the time attribute T of the output signal of each detection point includes: step 21, configuring two timers H and L at each detection point of the position sensor arranged at the first detection position along the movement direction of the flaky medium, and reading a signal voltage at each detection point of the sensor, and in a case that a voltage output from a certain detection point is changed from a low voltage to a high voltage, immediately resetting the timer H and starting timing if the timer H configured at the detection point does not start timing, or continuing timing if the timer H starts timing; step 22, resetting and stopping timer L configured at a certain detection point in a case that a voltage output from the detection point is a high voltage, or continuing, by timer L configured at a certain detection point, timing in a case that a voltage output from the detection point is a low voltage; and step 23, stopping timer H configured at all detection points in a case that voltages output from all detection points are low voltages, reading values of the timer H and the timer L of each detection point at the moment, respectively, and obtaining the time attribute T of each detection point by subtracting the value of the timer L configured at each detection point from the reading of the timer H configured at each detection point.

Preferably, step 4 of processing a signal of a position sensor arranged at other detection position in conjunction with the reference time Ta includes: step 41, starting a flow with reading an output voltage of the position sensor; step 42, determining whether a medium marker is set, where the medium marker is used to record whether a flaky medium is passing by the detection position, and the medium marker is set when the flaky medium arrives at the detection position, or the medium marker is cleared when the flaky medium departs from the detection position; and proceeding to step 45 in a case that it is determined that the medium marker is set, or proceeding to step 43 in a case that it is determined that the medium marker is not set; step 43, determining whether an output voltage of any one of the detection points is changed from a low voltage to a high voltage, and proceeding to step 44 in a case that it is determined that the output voltage of any one of the detection points is changed from a low voltage to a high voltage, or returning to step 41 in a case that it is determined that the output voltage of no detection point is changed from a low voltage to a high voltage; step 44, setting the medium marker, and starting the timer configured at the position sensor; step 45, determining whether the value of Tb of the timer is greater than the reference timing Ta, and proceeding to step 46 in a case that it is determined that the value of Tb of the timer is greater than the reference timing Ta, or returning to step 41 in a case that it is determined that the value of Tb of the timer is not greater than the reference timing Ta; step 46, determining whether output voltages of all detection points are low voltages, and proceeding to step 47 in a case that it is determined that the output voltages of all detection points are low voltages, or returning to step 41 in a case that the output voltages of not all detection points are low voltages; and step 47, ending the flow by clearing the medium marker and stopping and resetting the timer.

In the disclosure, the position sensor having multiple detection points is arranged at the first detection position along the movement direction of the flaky medium, and the common position sensor is arranged at other detection position, in this way, an accurate time period taken by a single flaky medium to pass by the detection position is obtained by the position sensor having multiple detection points at the first detection, and with reference to the time period, the determination made by the position sensor at other detection position that whether the flaky medium passes by is assisted, so that the precision for determining the medium position is improved, and a fake arrival/departure event due to a hole appeared randomly on the flaky medium or a transparent area arranged in different medium in advance can be avoided. In addition, compared with the conventional art, the software filtering algorithm is not required in the disclosure, which avoids setting a filtering parameter and frequently occupying the execution time of the CPU inside of the controller, therefore, it is beneficial for real-time control and high speed of the system. In the system, except that the position sensor having multiple detection points is required to be used at the first detection position, the common detector may be used at other detection positions, so that the flaky medium processing system may have a lower cost and a smaller volume.

BRIEF DESCRIPTION OF THE DRAWINGS

The disclosure is further illustrated in conjunction with the drawings and embodiments below.

DETAILED DESCRIPTION

The technical solution in the embodiments of the invention will be described clearly and completely below in conjunction with the drawings in the embodiments of the invention. Obviously, the described embodiments are only a part of the embodiments of the invention, and are not all embodiments. Based on the embodiments of the invention, other all embodiments acquired by those skilled in the art without paying any creative work will fall within the scope of protection of the disclosure.

Figure 1:
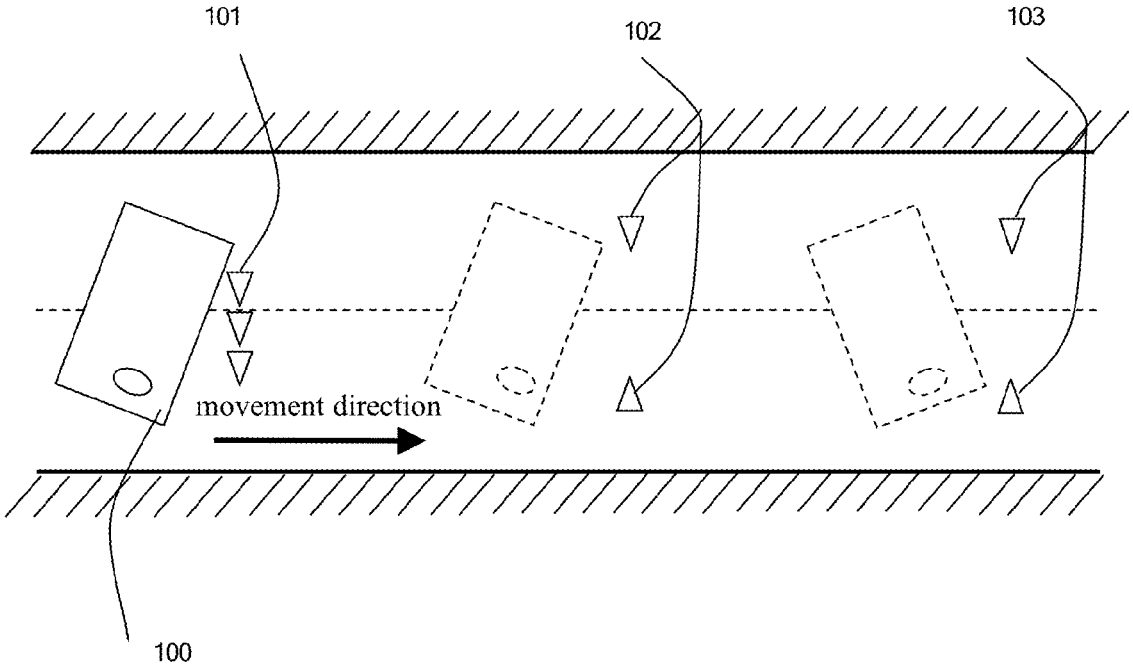
FIG. 1 is a schematic layout diagram of a position sensor in a flaky medium processing system provided by a preferred embodiment of the invention.

A flaky medium processing system provided by a preferred embodiment of the invention includes: a main controller configured to automatically control each component in the flaky medium processing system in a real-time manner; a medium storage apparatus configured to store a flaky medium; a medium recognizing apparatus configured to recognize, separate and count the flaky medium; a medium transfer apparatus including a motor, a drive mechanism and a medium transfer channel having multiple branches, where the multiple detection positions are arranged in the medium transfer channel, and one position sensor is arranged at each detection position for detecting an arrival event and a departure event of the flaky medium at the detection position, as shown in FIG. 1, a position sensor arranged at a first detection position along a movement direction of the flaky medium is provided with at least three independent detection points, each detection point outputs an independent output signal, and each detection point is configured with two timers for obtaining a time attribute of an output signal of each detection point, and the position sensor arranged at other detection position is configured with one timer for obtaining a time attribute of an output signal of the common position sensor.

Specifically, as shown in FIG. 1, at least three independent detection points are provided in the position sensor 101 which is arranged at a first detection position along a movement direction of the flaky medium, and at least one of the at least three independent detection points is aligned with a center line of the medium transfer channel. To the position sensor having such a structure, a case that a hole is detected by all detection points at the same time may be avoided, since that a probability of the hole appearing at all detection points at the same time is low, the more the detection points are, the lower the probability is.

The position sensors 102, 103 at other detection position at least include two detection points, and the two detection points are located at two sides of the center line of the medium transfer channel. In a case that any one of the detection points is covered, the sensor will output a high voltage signal. An object is that arrival and departure of the medium can also be detected accurately even when the medium tilts in the transfer channel. On the contrary, if the detection point is located at the center of the transfer channel, and the medium tilts, the following cases may occur: the sensor gives a medium arrival signal after a while when the medium arrived, and the sensor gives a medium departure signal before the medium leaves.

Figure 2:
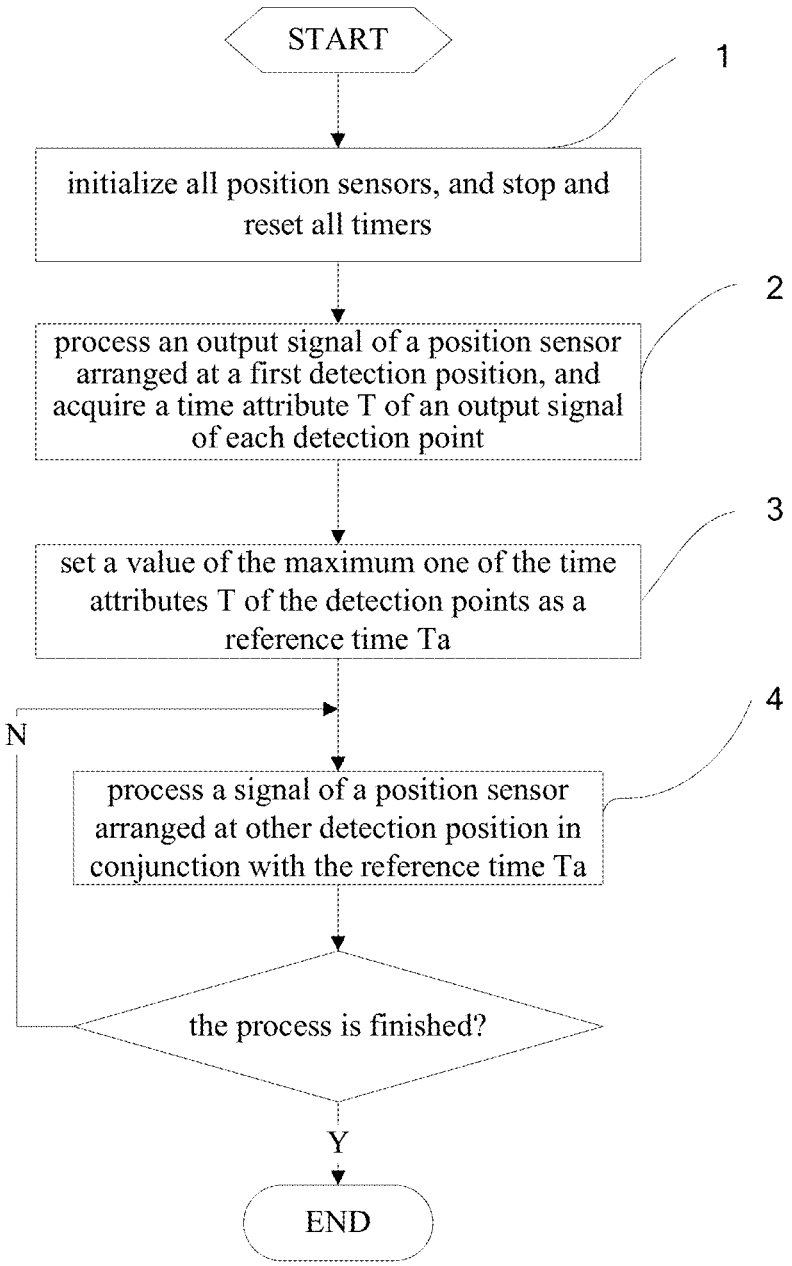
FIG. 2 is a general flow diagram of a method for detecting a real-time position of a flaky medium provided by a preferred embodiment of the invention.

A method for detecting a real-time position of the flaky medium by the flaky medium processing system is introduced below. The advantages of the method is that an arrival time point and a departure time point of the flaky medium may be determined accurately, and false triggering and a fake departure event due to the hole are avoided. An overall flow is shown in FIG. 2, which includes step 1 to step 4. In step 1, all position sensors are initialized, and all timers are stopped and reset. In step 2, an output signal of a position sensor arranged at a first detection position along a movement direction of the flaky medium is processed, and a time attribute T of an output signal of each detection point is acquired. In step 3, a value of the maximum one of the time attributes T of the detection points acquired in step 2 is set as a reference time Ta. In step 4, signals of position sensors arranged at other detection positions are processed in conjunction with the reference time Ta, specifically, in a case that any one of detection points of a position sensor is covered, it is determined that the flaky medium arrives at a detection position, and a timer equipped in the position sensor is started and continues timing, to acquire the time Tb when the flaky medium is detected passes by the position sensor, and in a case that all detection points of the position sensor are not blocked, and Tb is greater than Ta, it is determined that the flaky medium is away from the detection position, and the timer equipped in the position sensor is stopped and reset.

Specifically, step 2 of acquiring the time attribute T of the output signal of each detection point includes step 21, step 22 and step 23. In step 21, each detection point of the position sensor arranged at the first detection position along the movement direction of the flaky medium is configured with two timers H and L, a signal voltage at each detection point of the sensor is read, in a case that a voltage output from a certain detection point is changed from a low voltage to a high voltage, the timer H is reset immediately and starts timing if the timer H configured at the detection point does not start timing, or the timer H continue timing if the timer H already starts timing. In step 22, in a case that a voltage output from a certain detection point is a high voltage, the timer L configured at the detection point is reset and stopped, or in a case that the voltage output from the certain detection point is a low voltage, the timer L continue timing. In step 23, in a case that voltages output from all detection points are low voltages, the timer H configured at the all detection points are stopped, and values of the timer H and the timer L of each detection point at the moment are read respectively, and the time attribute T of each detection point is obtained by subtracting the value of the timer L configured at each detection point from the value of the timer H configured therein.

Figure 3:
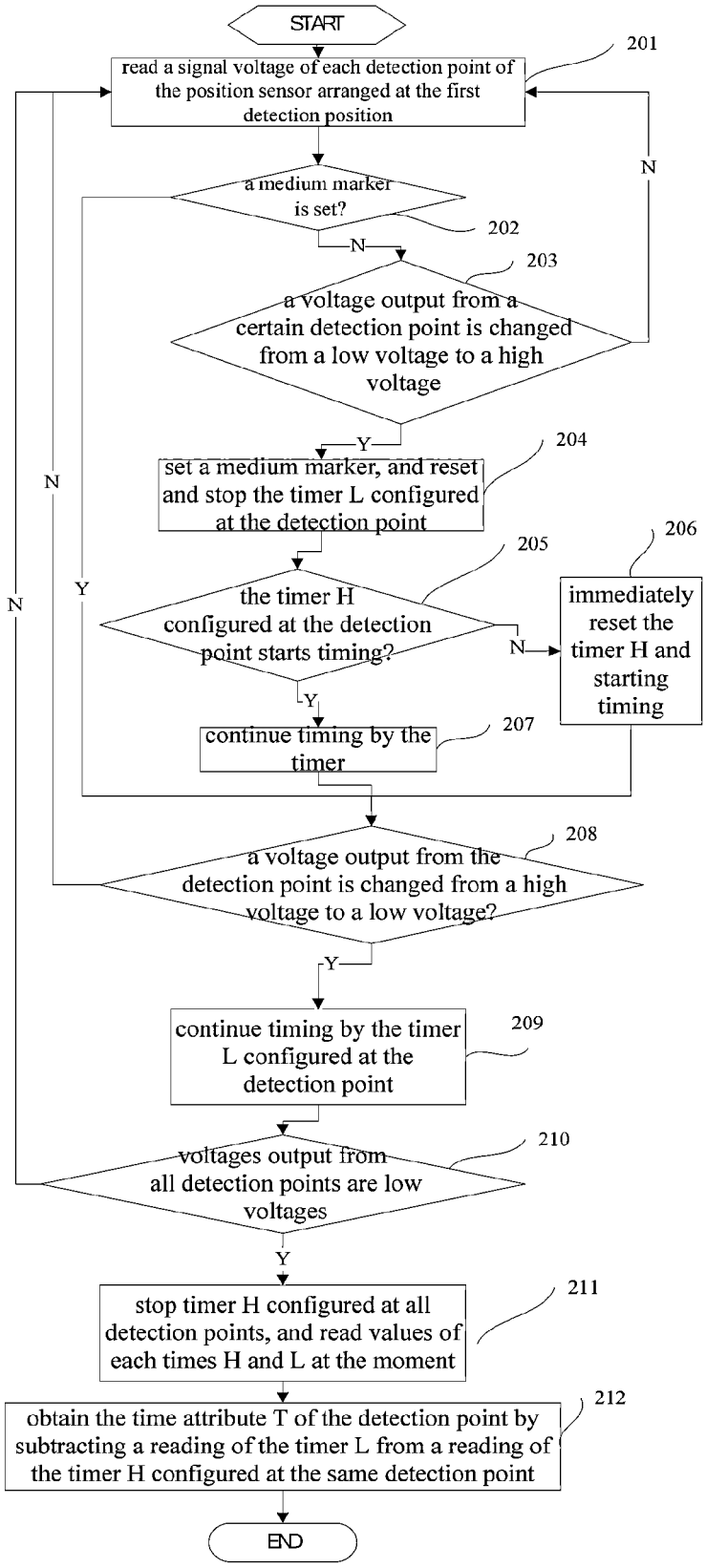
FIG. 3 is a step flow diagram of obtaining a time attribute of multiple detection points of a position sensor arranged at a first detection position.

Specifically, as shown in FIG. 3, a flow is as follows. In step 201, the flow is started, a voltage signal of each detection point of the position sensor 101 arranged at the first detection position is read, and the flow proceeds to step 202. In step 202, it is checked whether a medium marker is set, and in a case that the medium marker is set, the flow proceeds to step 208, or in a case that the medium marker is not set, the flow proceeds to step 203. In step 203, it is determined whether a voltage output from a certain detection point is changed from a low voltage into a high voltage, and in a case that the voltage is changed from a low voltage to a high voltage, the flow proceeds to step 204, or in a case that the voltage is not changed from a low voltage to a high voltage, the flow returns to step 201. In step 204, a medium marker is set, and the timer L configured at the detection point is reset and stopped, and the flow proceeds to step 205. In step 205, it is determined whether the timer H configured at the detection point starts timing, and in a case that the timer H configured at the detection point starts timing, the flow proceeds to step 207, or in a case that the timer H configured at the detection point does not start timing, the flow proceeds to step 206. In step 206, the timer H is reset immediately and starts timing, and the flow proceeds to step 208. In step 207, the timer H continues timing, and the flow proceeds to step 208. In step 208, it is determined a voltage output from the detection point is changed from a high voltage to a low voltage, and in a case that the voltage output from the detection point is changed from a high voltage to a low voltage, the flow proceeds to step 209, or in a case that the voltage output from the detection point is not changed from a high voltage to a low voltage, the flow returns to step 201. In step 209, the timer L configured at the detection point continues timing, the flow returns to step 210. In step 210, it is determined whether voltages output from all detection points are low voltages, in a case that the voltages output from all detection points are low voltages, the flow proceeds to step 211, or in a case that the voltages output from all detection points not are low voltages, the flow returns to step 201. In step 211, timer H configured at all detection points are stopped, and values of each times H and L at the moment are read respectively, and the flow proceeds to step 212. In step 212, the time attribute T of a detection point is obtained by subtracting a value of the timer L configured at the detection point from a value of the timer H configured therein. The method for calculating the time attribute T of each detection point may refer to FIG. 4, T1=TH1−TL1, T2=TH2−TL2, T3=TH3−TL3. Then, the maximum value is set as the reference time Ta, Ta=max(T1, T2, T3).

Figure 4:
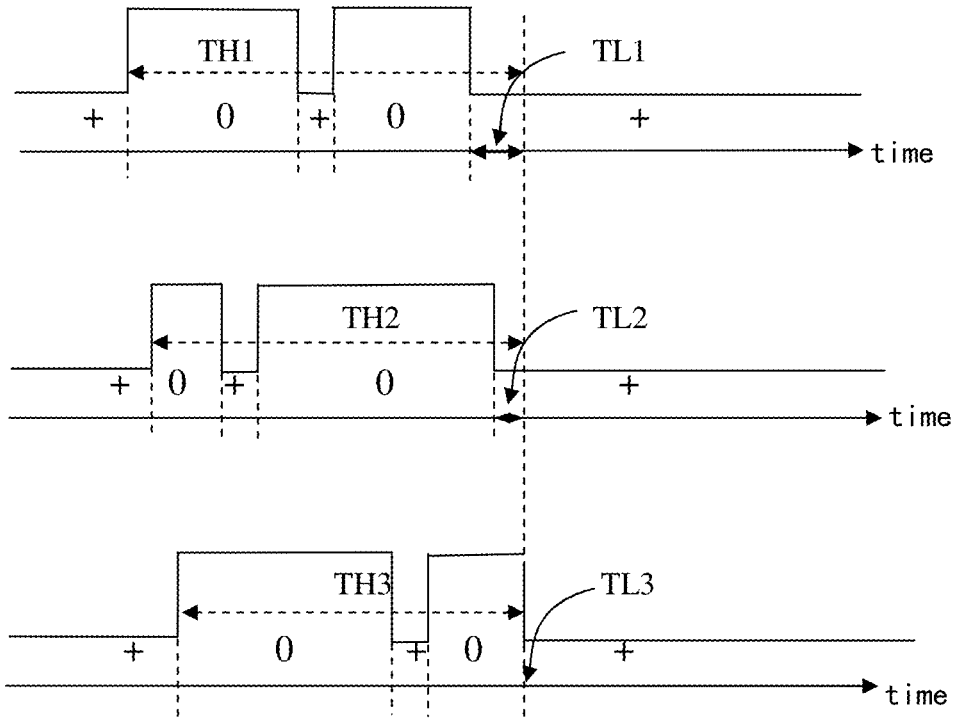
FIG. 4 is a schematic diagram of a method for acquiring the time attribute in FIG. 3.

That is, the main controller monitors a signal voltage output from each detection point of the position sensor 101 installed at the first detection position along the movement direction of the flaky medium, and in a case that a signal voltage output from one of the detection points is a high voltage, the main controller regards that there is a medium passing by the sensor, and in a case that the signal voltage output from each detection point is a low voltage, the main controller determines that there is no medium passing by the sensor, and there is no need to delay time to confirm. And the main controller use the method as shown in FIG. 3 and FIG. 4 to measure the time attribute T of the output signal of each detection point respectively, and set a value of the maximum one of the time attributes T as the reference time Ta.

Figure 5:
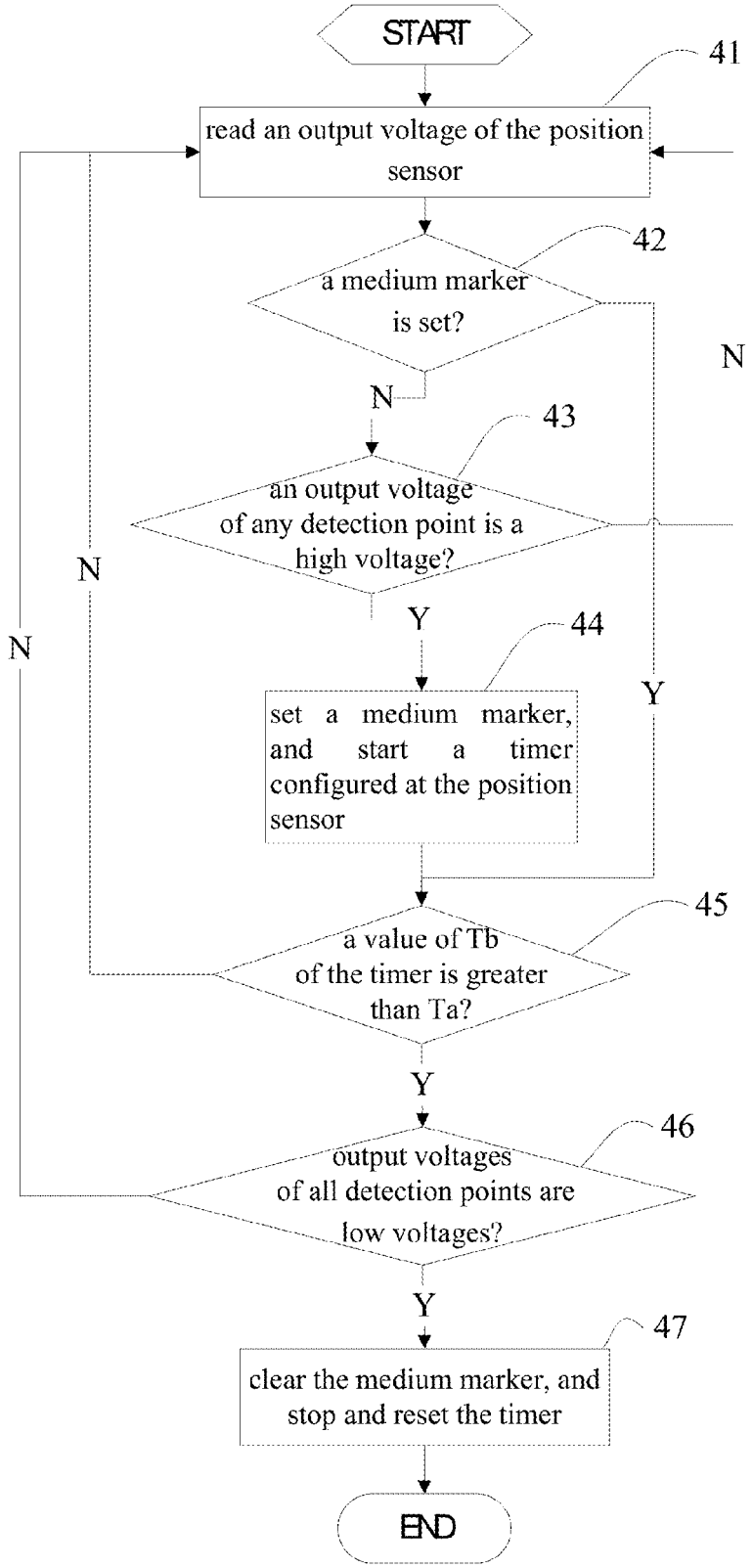
FIG. 5 is a flow diagram of signal processing of a position sensor arranged at other detection position.

Step 4 of processing the signal of the position sensor arranged at other detection position in conjunction with the reference time Ta is shown in FIG. 5, which includes step 41 to step 47. In step 41, a flow is started, and an output voltage of the position sensor is read. In step 42, it is determined whether a medium marker is set, where the medium marker is used to record whether the flaky medium is passing by the detection position, in a case that the flaky medium arrives at the detection position, the medium marker is set, or in a case that the flaky medium departs from the detection position, the medium marker is cleared, in a case that it is determined that the medium marker is set, the flow proceeds to step 45, or in a case that it is determined that the medium marker is not set, the flow proceeds to step 43. In step 43, it is determined whether an output voltage of any detection point is changed from a low voltage to a high voltage, in a case that it is determined that the output voltage is changed from a low voltage to a high voltage, the flow proceeds to step 44, or in a case that it is determined that no output voltage is changed from a high voltage to a low voltage, the flow returns to step 41. In step 44, the medium marker is set, and a timer configured at the position sensor is started. In step 45, it is determined whether a value of Tb of the timer is greater than the reference time Ta, and in a case that the value of Tb of the timer is greater than the reference time Ta, the flow proceeds to step 46, or in a case that the value of Tb of the timer is not greater than the reference time Ta, the flow returns to step 41. In step 46, it is determined whether output voltages of all detection points are low voltages, and in a case that the output voltages of all detection points are low voltages, the flow proceeds to step 47, or in a case that output voltages of not all detection points are low voltages, the flow returns to step 41. In step 47, the flow is ended by clearing the medium marker and stopping and resetting the timer.

That is, in a case that a signal voltage output from any one of the detection points is a high voltage, it is determined that there is a medium that arrives at the position sensor; in a case that the signal voltage output from any one of the detection points is changed from a low voltage to a high voltage, the timer is reset and starts timing if the timing is not started, or the timing is continued in a case that the timing is started. The main controller determines based on the value of Tb of the timer, in a case that Tb is less than Ta, the main controller determines that the medium is passing by the sensor and the timing is continued no matter that the voltage signal output from the detection point is a high voltage or a low voltage, or in a case that Tb is greater than or equal to Ta, the main controller monitor the voltage signal output from each detection point of the sensor, and the timer is stopped timing and it's immediately determined that the medium is away from the sensor if the voltage signal output from each detection point is a low voltage, and there is no need to delay time.

The method has better tolerance for a case that the medium tilts in the transfer channel. (1) tolerance for a maximum tilted angle: as long as that one of two sides of four sides of a rectangle medium arrives at each detection point first and departs from each detection point last, where the two sides are vertical to the movement direction. (2) tolerance for a change of the tilted angle during the a transfer process: in a case that a tilted angle formed when the medium passes by the position sensor having multiple detection points at the first detection position is different from a tilted angle formed when the medium passes by the common position sensor, a relative change value of the measured time is cos(b)/cos(a), and in a case that a change value of the tilted angle is within 10 degree, the relative change value is not more than 2%. Furthermore, since the signal processing method of the common position sensor described above is applied, the disclosure has a self-synchronization characteristic for the change.

Finally, the above embodiments are only intended to illustrate the technical solution of the disclosure, and are not intended to limit, although the disclosure is illustrated in detail with reference to the preferred embodiments, it should be understood by those skilled in the art that modifications and equivalent substitutions made to the technical solution of the disclosure without departing from a purpose and scope of the technical solution of the disclosure will fall within the scope of claims of the disclosure.

The invention claimed is:

1. A flaky medium processing system, comprising:

a main controller configured to automatically control each component in the flaky medium processing system in a real-time manner;

a medium storage apparatus configured to store a flaky medium;

a medium recognizing apparatus configured to recognize, separate and count the flaky medium;

a medium transfer apparatus comprising a motor, a drive mechanism and a medium transfer channel having a plurality of branches, wherein a plurality of detection positions are arranged in the medium transfer channel, and one position sensor is arranged at each detection position for detecting an arrival event and a departure event of the flaky medium at the detection position, characterized in that a position sensor arranged at a first detection position along a movement direction of the flaky medium is provided with at least three independent detection points, each detection point outputs an independent output signal, and each detection point is configured with two timers for obtaining a time attribute of an output signal of each detection point, and a position sensor arranged at a second detection position is configured with one timer for obtaining a time attribute of an output signal of the position sensor arranged at the second detection position.

2. The flaky medium processing system according to claim 1, wherein at least one of the at least three independent detection points provided in the position sensor arranged at the first detection position along the movement direction of the flaky medium is aligned with a centre line of the medium transfer channel.

3. The flaky medium processing system according to claim 2, wherein the position sensor arranged at the second detection position comprises at least two detection points, and the two detection points are arranged at two sides of the centre line of the medium transfer channel.

4. A method for detecting a real-time position of a flaky medium, comprising:

step 1 comprising initializing all position sensors, and stopping and resetting all timers, wherein a first position sensor arranged at a first detection position along a movement direction of the flaky medium is provided with at least three detection points;

step 2 comprising processing an output signal of first position sensor, and acquiring a time attribute T of an output signal of each detection point of the first position sensor;

step 3 comprising setting a value of the maximum one of the time attributes T acquired in the step 2 as a reference time Ta; and step 4 comprising processing a signal of a second position sensor arranged at a second detection position in conjunction with the reference time Ta, wherein in a case that any one of detection points of the second position sensor is covered, it is determined that a flaky medium to be detected arrives at the second detection position, and a timer equipped at the second position sensor is started and continues timing to acquire a time period Tb, wherein during the time period Tb the flaky medium to be detected passes by the second position sensor, or in a case that all detection points of the second position sensor are not covered, and Tb is greater than Ta, it is determined that the flaky medium is away from the second detection position, and the timer equipped at the second position sensor is stopped and reset.

5. The method for detecting a real-time position of a flaky medium according to claim 4, wherein the step 2 of acquiring the time attribute T of the output signal of each detection point of the first position sensor comprises:

step 21 comprising configuring two timers H and L at each detection point of the first position sensor arranged at the first detection position along the movement direction of the flaky medium, and reading a signal voltage of each detection point of the first position sensor, and in a case that a voltage output from one of the detection points of the first position sensor is changed from a low voltage to a high voltage, immediately resetting the timer H and starting timing if the timer H configured at the one of the detection points of the first position sensor does not start timing, or continuing timing if the timer H starts timing;

step 22 comprising resetting and stopping timer L configured at one of the detection points of the first position sensor in a case that a voltage output from the one of the detection points of the first position sensor is a high voltage, or continuing timing by timer L configured at the one of the detection points of the first position sensor in a case that a voltage output from the one of the detection points of the first position sensor is a low voltage; and step 23 comprising stopping timer H configured at all detection points of the first position sensor in a case that voltages outputs from all detection points of the first position sensor are low voltages, reading values of the timer H and the timer L of each detection point of the first position sensor at the moment respectively, and obtaining the time attribute T of each detection point of the first position sensor by subtracting the value of the timer L configured at each detection point of the first position sensor from the value of the timer H configured at each detection point of the first position sensor.

6. The method for detecting a real-time position of a flaky medium according to claim 4, wherein the step 4 of processing a signal of a second position sensor at a second detection position in conjunction with the reference time Ta comprises:

step 41 comprising starting a flow with reading an output voltage of the second position sensor;

step 42 comprising determining whether a medium marker is set, wherein the medium marker is used to record whether a flaky medium is passing by the second detection position, and the medium marker is set when the flaky medium arrives at the second detection position, or the medium marker is cleared when the flaky medium departs from the second detection position; and proceeding to step 45 in a case that it is determined that the medium marker is set, or proceeding to step 43 in a case that it is determined that the medium marker is not set;

step 43 comprising determining whether an output voltage of any one of the detection points of the second position sensor is changed from a low voltage to a high voltage, and proceeding to step 44 in a case that it is determined that the output voltage of any one of the detection points of the second position sensor is changed from a low voltage to a high voltage, or returning to step 41 in a case that it is determined that the output voltage of no detection point of the second position sensor is changed from a low voltage to a high voltage;

step 44 comprising setting the medium marker, and starting the timer configured at the second position sensor;

step 45 comprising determining whether the value of Tb of the timer is greater than the reference timing Ta, and proceeding to step 46 in a case that it is determined that the value of Tb of the timer is greater than the reference timing Ta, or returning to step 41 in a case that it is determined that the reading Tb of the timer is not greater than the reference timing Ta;

step 46 comprising determining whether output voltages of all detection points of the second position sensor are low voltages, and proceeding to step 47 in a case that it is determined that the output voltages of all detection points of the second position sensor are low voltages, or returning to step 41 in a case that the output voltages of not all detection points of the second position sensor are low voltages; and step 47 comprising ending the flow by clearing the medium marker and stopping and resetting the timer.

* * * * *